US009433325B2

(12) United States Patent
Austin, III

(10) Patent No.: US 9,433,325 B2
(45) Date of Patent: Sep. 6, 2016

(54) SLIDING SHOWER DOOR GUIDE AND DRAIN ASSEMBLY

(71) Applicant: LIBERTY HARDWARE MFG. CORP., Winston-Salem, NC (US)

(72) Inventor: James Allen Austin, III, High Point, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 164 days.

(21) Appl. No.: 14/166,006

(22) Filed: Jan. 28, 2014

(65) Prior Publication Data

US 2015/0208874 A1 Jul. 30, 2015

(51) Int. Cl.

| | |
|---|---|
| ***A47K 3/00*** | (2006.01) |
| ***A47K 3/34*** | (2006.01) |
| *A47K 3/30* | (2006.01) |

(52) U.S. Cl.

CPC ..... *A47K 3/34* (2013.01); *A47K 2003/305* (2013.01)

(58) Field of Classification Search

CPC ..... A47K 3/34; A47K 3/362; A47K 3/30; A47K 2003/305

USPC ..... 4/607, 596, 597, 610, 557; 49/410, 411, 49/408; 16/95 R

See application file for complete search history.

(56) References Cited

U.S. PATENT DOCUMENTS

| | | | | |
|---|---|---|---|---|
| 2,159,530 | A * | 5/1939 | Murphy | E06B 7/28 160/106 |
| 2,754,535 | A * | 7/1956 | Plemeng | E05D 15/063 16/87 R |
| 2,856,040 | A * | 10/1958 | Dansereau | A47K 3/34 16/95 R |
| 3,074,077 | A * | 1/1963 | Taubman | A47K 3/34 4/607 |
| 3,461,466 | A * | 8/1969 | Weaver | A47K 3/34 4/557 |
| 5,079,872 | A * | 1/1992 | Short | A47K 3/34 4/557 |
| 5,675,936 | A | 10/1997 | Kurth et al. | |
| 5,848,446 | A | 12/1998 | DeBraal | |
| 7,748,527 | B2 | 7/2010 | Wisecarver et al. | |
| 7,828,151 | B2 | 11/2010 | Murdoch et al. | |

(Continued)

FOREIGN PATENT DOCUMENTS

| | | |
|---|---|---|
| EP | 1123680 A1 | 8/2001 |
| EP | 1854929 A1 | 11/2007 |

OTHER PUBLICATIONS

European Search Report for corresponding European Application No. 15152794.2, mailed Jun. 18, 2015, 8 pages.

European Examination Report for corresponding Application No. 15 152 794.2, mailed May 12, 2016, 5 pages.

*Primary Examiner* — J. Casimer Jacyna
*Assistant Examiner* — Benjamin R Shaw
(74) *Attorney, Agent, or Firm* — Brooks Kushman P.C.; Lora Graentzdoerffer

(57) ABSTRACT

A guide and drain assembly has a drain channel with a base wall and first and second side walls extending along a longitudinal axis, and a cover extending over the channel. The cover has at least one guide channel extending along the longitudinal axis and positioned between first and second edge members. The at least one guide channel is formed by a first base section positioned between first and second sides. The at least one guide channel is sized to receive an edge portion of a sliding door of a shower door assembly. The base section of the at least one guide channel defines a series of apertures extending longitudinally and providing fluid communication between the guide channel and the drain channel.

19 Claims, 3 Drawing Sheets

(56) References Cited

U.S. PATENT DOCUMENTS 8,161,582 B2 * 4/2012 Hatrick-Smith ..... A47K 3/36 4/607
2005/0235571 A1 * 10/2005 Ewing ..... E05C 7/06 49/410
2013/0254984 A1 * 10/2013 Perez ..... A47K 3/36 4/607
2013/0325670 A1 12/2013 Austin, III et al.
2014/0259363 A1 * 9/2014 Ball ..... A47K 3/34 4/607

* cited by examiner

SLIDING SHOWER DOOR GUIDE AND DRAIN ASSEMBLY

TECHNICAL FIELD

Various embodiments relate to a guide system for a sliding door, such as a shower door assembly.

BACKGROUND

Shower enclosures often have glass doors that slide to enclose the bathing area and keep liquid water and/or steam in the bathing area. The shower enclosures may also have a separate continuous drain system adjacent to the entrance to the shower enclosure to drain liquid water from the shower enclosure.

SUMMARY

According to an embodiment, a guide assembly is provided with a drain channel having a base wall and first and second side walls extending along a longitudinal axis. A cover extends over the channel. The cover has a first guide channel and a second guide channel extending longitudinally and spaced apart by an intermediate member. The first guide channel is sized to receive an edge portion of a first sliding door of a shower door assembly. The second guide channel is sized to receive an edge portion of a second sliding door of the shower door assembly. A base section of the first channel defines a first series of apertures providing fluid communication between the first channel and the drain channel. A base section of the second channel defines a second series of apertures providing fluid communication between the second channel and the drain channel.

According to another embodiment, a guide and drain assembly for sliding doors is provided. A drain channel has a base wall and first and second side walls extending along a longitudinal axis. A cover extends over the channel. The cover has a first guide channel formed by a first base section positioned between first and second sides, and a second guide channel formed by a second base section positioned between third and fourth sides. The first and second guide channels extend longitudinally and are spaced apart by an intermediate member. A first edge member extends outwardly from the first guide channel, and a second edge member extends outwardly from the second guide channel. The first guide channel is sized to receive an edge portion of a first sliding door of a shower door assembly. The second guide channel is sized to receive an edge portion of a second sliding door of the shower door assembly. A base section of the first channel defines a first series of apertures extending longitudinally in the first channel and providing fluid communication between the first channel and the drain channel. A base section of the second channel defines a second series of apertures extending longitudinally in the first channel and providing fluid communication between the second channel and the drain channel. The intermediate member of the cover defines a third series of apertures extending longitudinally and in fluid communication with the drain channel.

According to yet another embodiment, a guide and drain assembly is provided. A drain channel has a base wall and first and second side walls extending along a longitudinal axis. A cover extends over the channel. The cover has at least one guide channel extending along the longitudinal axis and positioned between first and second edge members. The at least one guide channel is formed by a first base section positioned between first and second sides. The at least one guide channel is sized to receive an edge portion of a sliding door of a shower door assembly. The base section of the at least one guide channel defines a series of apertures extending longitudinally and providing fluid communication between the guide channel and the drain channel.

Various embodiments of the present disclosure have associated, non-limiting advantages. For example, the guide and drain assembly provides a single component for placement at the entry to a shower enclosure. The assembly provides a drainage function for the shower, which is partially hidden by the sliding shower doors, where liquid water flows through a cover and into a drainage channel. The cover includes guide channels that act as guides for the sliding doors to keep the sliding doors translating in a single plane of motion and prevent the doors from moving perpendicularly to the longitudinal sliding plane or direction

DETAILED DESCRIPTION

Figure 1:
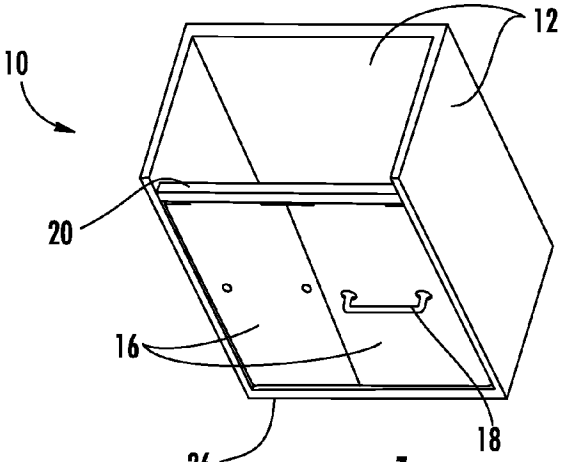
FIG. 1 is a perspective view of a shower assembly having sliding doors according to an embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIGS. 1-4 illustrate a shower enclosure 10 according to an embodiment. The shower enclosure 10 has one or more walls 12, and a floor 13. A shower head, valves to control the flow and temperature of water to the shower head may be provided within the enclosure 10.

The walls 12 and the threshold 14 cooperate to provide an opening or doorway to the shower enclosure 10 for gaining access to or leaving the shower enclosure 10. The opening may be covered by one or more sliding doors 16. In other embodiments, the doors 16 may be pivotally mounted to the shower enclosure 10.

The sliding doors 16 may be framed or frameless glass panels, may be made from a plastic panel, or from another material as is known in the art. The doors 16 may be one or more towel bars or handles 18 mounted to the door.

The sliding doors 16 are hung on an upper track 20. The upper track 20 may be mounted to two opposed side walls 12 or a ceiling or top wall (not shown). The sliding doors 16 have a mechanism (not shown) such as a roller system or the like, that allows the sliding doors to move along a longitudinal axis 22. The upper track 20 may have a pair of guide rails, one for each mechanism on each door 16 such that the doors are offset from one another along a transverse or lateral axis 24. This also allows one door to slide behind the other door, and vice versa, to open and close the opening to the enclosure 10. In other embodiments, a single sliding door may be provided, that slides over an adjacent wall section when open, for example, one of the door panels as shown may be fixed in place while the other is movable A integrated drain and guide system or assembly 26 that guides the sliding doors 16 and provides a drain is provided at the threshold of the opening to the shower enclosure 10. The assembly 26 replaces a conventional bottom track and separate drain system near the threshold.

Generally, sliding shower doors are provided with a guiding system to keep the doors tracking along their intended plane of travel as they move. In conventional systems, the guiding system may include a bottom track attached to the threshold of the shower enclosure that has hardware such as flanges or the like to restrict the movement of the doors perpendicular to the plane of travel, or in the lateral direction 24. The conventional bottom track and associated hardware may be visually unappealing, and may provide a place for dirt and/or grime to accumulate. Conventional shower enclosures may also be provided with a continuous drain system located at the entrance to the bathing area, or near the threshold, and spaced apart from the bottom track. These drains are often rectangular in shape and covered by a grate, such as a metal grate that is perforated to allow water to enter the drain system and leave the shower enclosure.

The assembly 26 of the present disclosure replaces both the conventional bottom guide track and continuous drain system. The assembly 26 is formed such that it functions both as a drain grate, and as a guiding mechanism for the shower doors 16. The assembly 26 also eliminates the need for a bottom track for the shower door assembly. The assembly 26 may provide an improved visual appearance for the shower door assembly, as the drain system is less visible, and the bottom track may protrude less into the opening to the shower enclosure.

Figure 2:
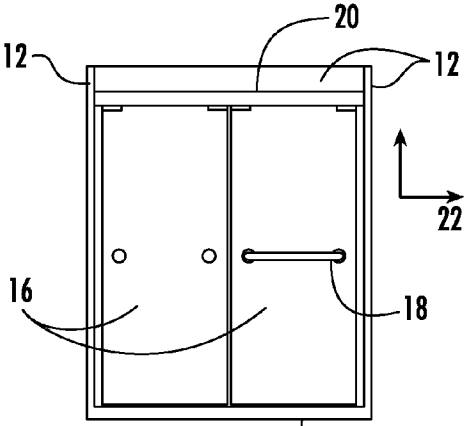
FIG. 2 is a front perspective view of the shower assembly of FIG. 1.
Figure 4:
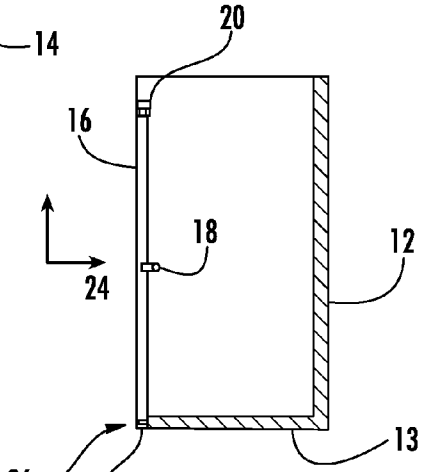
FIG. 4 is a sectional view of the shower assembly of FIG. 1.
Figure 3:
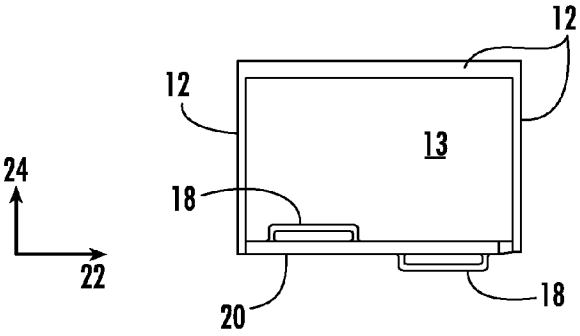
FIG. 3 is a top perspective view of the shower assembly of FIG. 1.
Figure 5:
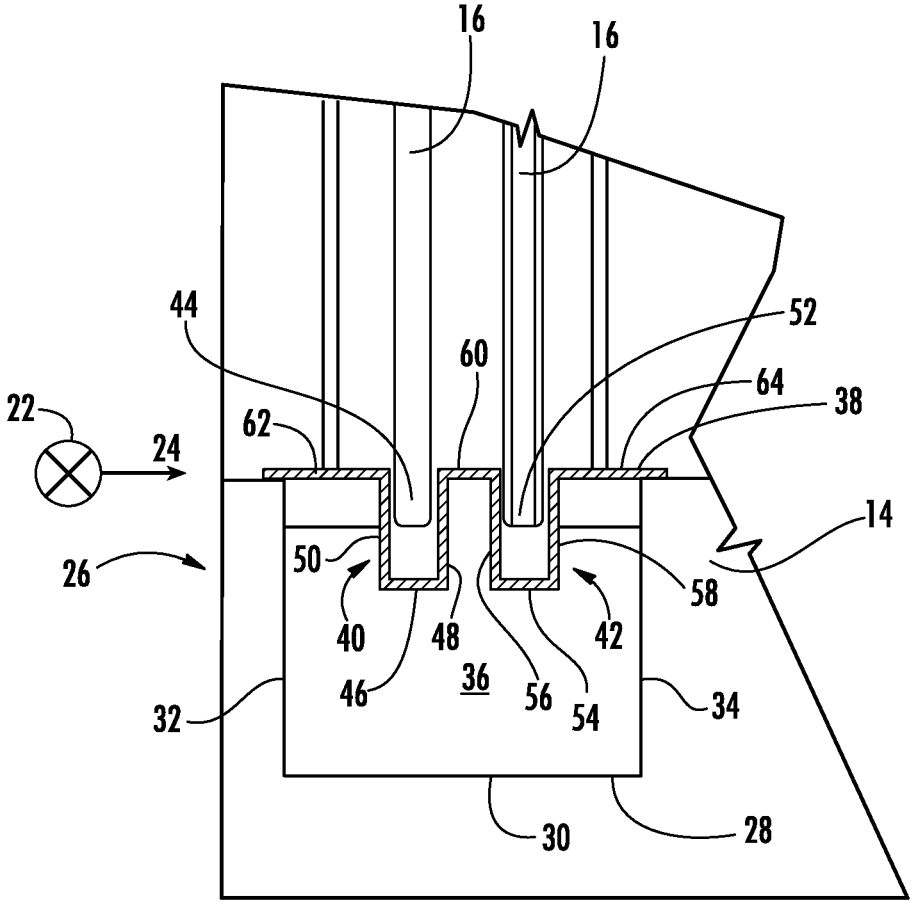
FIG. 5 is a detailed view of a guide and drain assembly in the shower assembly of FIG. 4 according to an embodiment.
Figure 6:
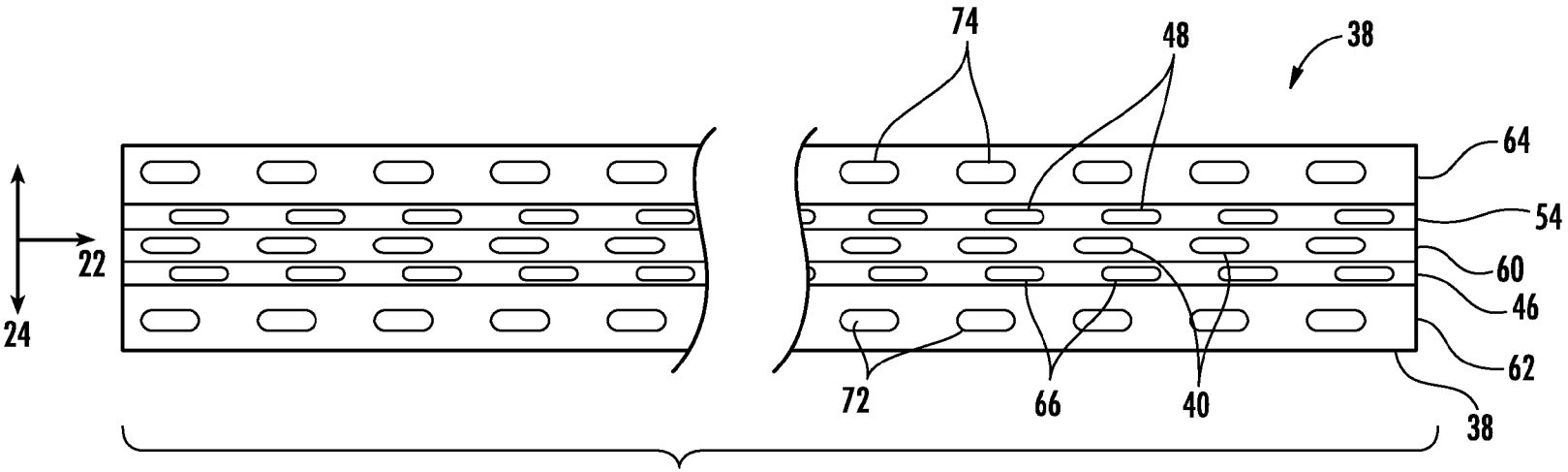
FIG. 6 is a top perspective view of a cover for use with the guide and drain assembly of FIG. 5.

FIG. 5 illustrates the assembly 26 in greater detail and is a view taken along the longitudinal axis of the assembly. FIG. 6 illustrates a top view illustrating a cover member for the assembly 26. assembly may extend the length of the opening to the shower enclosure, for example, from wall 12 to wall 12 as shown in FIG. 2.

The assembly 26 has a drain channel 28. The drain channel 28 has a base wall 30 and first and second side walls 32, 34 extending along the longitudinal axis 22. The drain channel 28 may have a generally rectangular cross section, as shown. The drain channel 28 may define an aperture to connect to a fitting to a drain pipe (not shown). The base wall 30 of the drain channel may be inclined or sloped towards the aperture to drain water, and the aperture may be located adjacent to one of the ends of the channel. The drain channel 28 may have a pair of end walls 36 at opposed ends of the channel 28.

The assembly 26 also has a cover member, or cover, 38. The cover 38 extends over the drain channel 28 to cover the drain channel, and has a length approximately equal to or greater than the length of the drain channel 28, and a width that is approximately equal to or greater than the width of the drain channel 28. The drain channel 28 and the cover 38 may be made from a metal such as aluminum or an aluminum alloy, or may be made from another suitable material.

The cover 38 has at least one guide channel, with one guide channel provided per sliding door. The cover 38 as shown has a first guide channel 40 and a second guide channel 42. The guide channels 40, 42 extend longitudinally and may be generally parallel to one another.

The first guide channel 40 is sized to receive an edge portion 44 of a first sliding door 16 of a shower door assembly. The edge portion 44 may be a frameless glass panel as shown, or may be a guide from a frame surrounding a panel. The first guide channel 40 has a base section 46 and first and second side portions 48, 50. The base section 46 is positioned between and connected to a lower edge of the first and second side portions 48, 50. The first guide channel 40 allows longitudinal movement of the door 16 and restricts transverse movement of the sliding door 16 using the side portions 48, 50. The first and second side portions 48, 50 may be parallel to one another as shown, and perpendicular to the base section 46. In other embodiments, the portions and sections 46, 48, 50 may be at other angles relative to one another. A dimension of the side portions 48, 50 in the vertical direction may be greater than a dimension of the base section 46 in the lateral direction 24.

The second guide channel 42 is sized to receive an edge portion 52 of a second sliding door 16 of a shower door assembly. The second guide channel 42 has a base section 54 and first and second side portions 56, 58. The base section 54 is positioned between and connected to a lower edge of the first and second side portions 56, 58. The second guide channel 42 allows longitudinal movement of the door 16 and restricts transverse movement of the sliding door 16 using the side portions 56, 58. The first and second side portions 56, 58 may be parallel to one another as shown, and perpendicular to the base section 54. In other embodiment, the sections 54, 56, 58 may be at other angles relative to one another. A dimension of the side portions 56, 58 in the vertical direction may be greater than a dimension of the base section 54 in the lateral direction 24. In one example, the second guide channel 42 has the same dimensions as the first guide channel 40.

The two guide channels 40, 42 are spaced apart by an intermediate member 60. The intermediate member 60. The intermediate member 60 is connected to the upper portion or edge of the side portions 48, 56.

A first edge member 62 extends outwardly or transversely from the first guide channel 40 and may be connected to an upper portion or edge of the side portion 50. The first edge member 62 extends from the first guide channel 40 to the wall 32 of the drain channel 28.

A second edge member 64 extends outwardly or transversely from the second guide channel 42 and may be connected to an upper portion or edge of the side portion 58. The second edge member 64 extends from the second guide channel 42 to the wall 34 of the drain channel 28.

The sides 48, 50, 56, 58 of the guide channels extend between and connect the edge members 62, 64 to the base sections 46, 54, and the base sections 46, 54 to the intermediate member 60. In one example, the sides 48, 50, 56, 58 are parallel to one another. The base sections 46, 54 may be defined by a common, lower plane, or alternatively, may be defined by two different planes that are parallel or nonparallel to one another. The edge members 62, 64 and the intermediate member 60 may be defined by a common, upper plane, or alternatively, may be defined by two or three different planes that are parallel or nonparallel to one another. In a further example, the upper plane and lower plane are parallel to one another.

Apertures or drainage holes are provided through the cover 38 to allow water to drain from the shower enclosure or bathing area into the drain channel 28, as can be seen in FIG. 6. The base section 46 of the first channel 40 defines a series of apertures 66 extending longitudinally in the first channel 40 and providing fluid communication between the first channel 40 and the drain channel 28. The base section 54 of the second channel 42 defines a series of apertures 68 extending longitudinally in the second channel 42 and providing fluid communication between the second channel 42 and the drain channel 28.

In some examples, the intermediate member 60 of the cover defines a series of apertures 70 extending longitudinally and in fluid communication with the drain channel 28. The first edge member 62 defines a series of apertures 72 in fluid communication with the drain channel 28. The second edge member 64 defines a series of apertures 74 in fluid communication with the drain channel 28. In some examples, the cover 38 has the apertures as described above, in other examples, the cover 38 may have apertures as described on some of the members and section and not on others. For example, the cover 38 may not have apertures on the edge member that is positioned on the other side of the shower enclosure from the doors 16.

The apertures in one of the series of apertures may be the same size or may be various sizes. Similarly, the apertures in one series compared to another series may be the same size or different sizes.

The apertures in a series of apertures may be elongated such that a dimension along the longitudinal axis 22 is greater than a dimension along the transverse axis 24. The apertures in a series of apertures, for example, series 66 or 68, may be spaced apart from an end 36 of the assembly or an end of the cover 38 by no more than a length of an aperture taken along the longitudinal axis 22. The apertures in a series may have a longitudinal length that is greater than a transverse width of the channel or member in which they are formed. The apertures in a series of apertures may be an elongated rectangular with curved corners as shown, or alternatively may be other shapes, including, but not limited to circles, ellipses, rectangles, and other shapes. The apertures in a series of apertures may be aligned end to end as shown, or alternatively may be arranged in another manner, for example, positioned such that the apertures are elongated transversely or are angled with respect to the longitudinal axis 22.

The cover 38 may be formed from a metal, such as aluminum or an aluminum alloy, or another suitable material, including plastic. In one example, the cover 38 is formed from a flat sheet or plate and is bent, extruded, or the like to form the channels. A cross-section of the cover 38 may appear as a W-shape. The apertures may be machined or otherwise formed into the cover before or after the channels are formed. Alternatively, if the cover 38 is molded or similarly formed, the shape and the apertures may be formed simultaneously.

A shower door assembly may be installed into a shower enclosure as follows. The guide assembly 26 is installed in an opening to a bathing area or shower enclosure on a threshold 14 of the opening. A track 20 is provided and installed above the guide assembly 26. The sliding doors 16 are connected to the track 20 such that they may longitudinally translate along the track 20, and with their respective lower edge portions 44, 52 positioned within the guide channels 40, 42 of the assembly 26.

Various embodiments of the present disclosure have associated, non-limiting advantages. For example, the guide and drain assembly provides a single component for placement at the entry to a shower enclosure. The assembly provides a drainage function for the shower, which is partially hidden by the sliding shower doors, where liquid water flows through a cover and into a drainage channel. The cover includes guide channels that act as guides for the sliding doors to keep the sliding doors translating in a single plane of motion and prevent the doors from moving perpendicularly to the longitudinal sliding plane or direction.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A guide assembly comprising:

a drain channel having a base wall and first and second side walls extending along a longitudinal axis; and a cover extending over the channel, with a first guide channel and a second guide channel extending longitudinally and spaced apart by an intermediate member, the first guide channel sized to receive an edge portion of a first sliding door of a shower door assembly, the second guide channel sized to receive an edge portion of a second sliding door of the shower door assembly, the cover having a first edge member extending transversely outward from the first channel;

wherein a base section of the first channel defines a first series of apertures providing fluid communication between the first channel and the drain channel; and wherein a base section of the second channel defines a second series of apertures providing fluid communication between the second channel and the drain channel; and wherein the first edge member defines a third series of apertures in fluid communication with the drain channel.

2. The guide assembly of claim 1 wherein the first guide channel allows longitudinal movement and restricts transverse movement of the first sliding door; and wherein the second guide channel allows longitudinal movement and restricts transverse movement of the second sliding door.

3. The guide assembly of claim 1 wherein the intermediate member of the cover defines a third series of apertures in fluid communication with the drain channel.

4. The guide assembly of claim 1 wherein the cover further comprises a second edge member extending transversely outward from the second channel.

5. The guide assembly of claim 4 wherein the second edge member defines a series of apertures in fluid communication with the drain channel.

6. The guide assembly of claim 1 wherein the first series of apertures, as a whole, extends longitudinally, and the second series of apertures, as a whole, extends longitudinally.

7. The guide assembly of claim 1 wherein an aperture of the first series of apertures is spaced apart from an end of the first channel by no more than a length of an aperture.

8. The guide assembly of claim 1 wherein each aperture in the first series of apertures is longitudinally elongated.

9. The guide assembly of claim 1 wherein each aperture in the first series of apertures has a longitudinal length that is greater than a transverse width of the first channel.

10. A method of installing a shower door assembly, the method comprising:

installing a guide assembly according to claim 1 in an opening to a bathing area, the guide assembly installed on a threshold of the opening;

providing a track for a first sliding door above the guide assembly; and installing a first sliding shower door onto the track with a bottom edge of the first door received within the first channel.

11. The method of claim 10 further comprising installing a second sliding shower door onto the track with a bottom edge of the second door received within the second channel.

12. A guide and drain assembly for sliding doors comprising:

a drain channel having a base wall and first and second side walls extending along a longitudinal axis; and a cover extending over the channel, with a first guide channel formed by a first base section positioned between first and second sides, and a second guide channel formed by a second base section positioned between third and fourth sides, the first and second guide channels extending longitudinally and spaced apart by an intermediate member, a first edge member extending outwardly from the first guide channel, and a second edge member extending outwardly from the second guide channel, the first guide channel sized to receive an edge portion of a first sliding door of a shower door assembly, the second guide channel sized to receive an edge portion of a second sliding door of the shower door assembly;

wherein a base section of the first channel defines a first series of apertures, the first series of apertures, as a whole, extending longitudinally in the first channel and providing fluid communication between the first channel and the drain channel;

wherein a base section of the second channel defines a second series of apertures, the second series of apertures, as a whole, extending longitudinally in the second channel and providing fluid communication between the second channel and the drain channel; and wherein the intermediate member of the cover defines a third series of apertures, the third series of apertures, as a whole, extending longitudinally and in fluid communication with the drain channel.

13. The guide and drain assembly of claim 12 wherein the first edge member defines a fourth series of apertures in fluid communication with the drain channel; and wherein the second edge member defines a fifth series of apertures in fluid communication with the drain channel.

14. The guide and drain assembly of claim 12 wherein the first and second base section are along a lower plane of the cover; and wherein the intermediate member, the first edge member and the second edge member are along an upper plane of the cover, the upper plane parallel with the lower plane.

15. The guide and drain assembly of claim 14 wherein the first and second sides extend from the upper plane to the lower plane to connect the base section of the first channel to the first edge member and the intermediate member respectively; and wherein the third and fourth sides extend from the upper plane to the lower plane to connect the base section of the second channel to the second edge member and the intermediate member respectively.

16. The guide and drain assembly of claim 15 wherein the first, second, third, and fourth sides are parallel to one another.

17. A shower door assembly comprising:

a first and second sliding door panel;

an upper track adapted to support the first and second sliding doors for longitudinal motion along the track, the first and second sliding doors transversely spaced apart by the upper track; and a lower guide and drain assembly according to claim 12 positioned below the upper track;

wherein the first guide channel of the guide and drain assembly allows longitudinal movement and restricts transverse movement of the edge portion of the first sliding door; and wherein the second guide channel allows longitudinal movement and restricts transverse movement of the edge portion of the second sliding door.

18. A guide and drain assembly comprising:

a drain channel having a base wall and first and second side walls extending along a longitudinal axis, the drain channel having first and second end walls at opposed ends of the drain channel to be spaced apart along the longitudinal axis, the base wall of the drain channel being sloped towards one of the first and second end walls; and a cover extending over the channel, with at least one guide channel extending along the longitudinal axis and positioned between first and second edge members, the at least one guide channel formed by a first base section positioned between first and second sides, the at least one guide channel being sized to receive an edge portion of a sliding door of a shower door assembly, wherein the base section of the at least one guide channel defines a series of apertures extending longitudinally and providing fluid communication between the guide channel and the drain channel;

wherein the first edge member and the second edge member are along an upper plane of the cover, and the base section is defined by a lower plane, the upper plane parallel with the lower plane.

19. The guide assembly of claim 1 wherein the base section of the first channel and the base section of the second channel are along a lower plane;

wherein the intermediate member and the first edge member are along an upper plane; and wherein the upper and lower plane are parallel to one another.

* * * * *